United States Patent [19]

Inamori et al.

[11] Patent Number: 4,691,874

[45] Date of Patent: Sep. 8, 1987

[54] METHOD AND APPARATUS FOR WINDING WIRE ROD

[75] Inventors: Hiroo Inamori, Nagoya; Sigeyuki Nasuda, Chita; Yoshio Morimoto, Aichi; Takayuki Haruna, Chita, all of Japan

[73] Assignee: Daido Tokushuko Kabushiki Kaisha, Nagoya, Japan

[21] Appl. No.: 933,328

[22] Filed: Nov. 21, 1986

Related U.S. Application Data

[63] Continuation of Ser. No. 769,694, Aug. 27, 1985, abandoned.

[51] Int. Cl.[4] ..... B65H 54/00; B65H 54/80

[52] U.S. Cl. ..... 242/80; 242/25 A; 242/81

[58] Field of Search ..... 242/80, 81, 25 A, 18 A

[56] References Cited

U.S. PATENT DOCUMENTS

| | | | |
|---|---|---|---|
| 224,838 | 2/1880 | Morgan et al. | 242/80 |
| 224,942 | 2/1880 | Morgan et al. | 242/80 |
| 434,190 | 8/1890 | Matteson | 242/81 |
| 445,965 | 2/1891 | Daniels | 242/80 |
| 458,760 | 9/1891 | Allis | 242/81 |
| 1,637,700 | 8/1927 | Lee et al. | 242/80 |
| 1,721,352 | 7/1929 | Naugle et al. | 242/80 |
| 1,762,289 | 6/1930 | Dahlstrom | 242/81 |
| 1,881,018 | 10/1932 | Cary | 242/80 |
| 2,321,646 | 6/1943 | Blodgett | 242/80 |

FOREIGN PATENT DOCUMENTS

| | | | |
|---|---|---|---|
| 46636 | 4/1889 | Fed. Rep. of Germany | 242/80 |

*Primary Examiner*—Stanley N. Gilreath

*Attorney, Agent, or Firm*—Oblon, Fisher, Spivak, McClelland, & Maier

[57] ABSTRACT

An apparatus for winding wire rods which are fed in succession from a rolling mill along a wire path, comprising: a carriage which is movable, at one end of the wire path remote from the rolling mill; in a direction perpendicular to the wire path; plural wire winders for winding the wire rods, the wire winders being mounted on the carriage such that the wire winders are disposed in the direction of movement of the carriage; and a device for moving the carriage to position selected so that one of the wire winders is in its winding position. A winding method is also disclosed, which comprises: positioning one of the wire winders at its winding position and winding the wire rod as a first coil by this one wire winder; upon completion of winding of the wire rod as the first coil, positioning the above one wire winder to its non-winding position before the leading end of the next wire rod fed from the rolling mill reaches the end of the wire path, and positioning another wire winder in its winding position; and winding the next wire rod as a second coil by this another wire winder, while concurrently taking out the first coil from the previously operated wire winder.

3 Claims, 5 Drawing Figures

METHOD AND APPARATUS FOR WINDING WIRE ROD

This application is a continuation of application Ser. No. 769,694, filed on Aug. 27, 1985, now abandoned.

BACKGROUND OF THE INVENTION

1. Field of the Art

The present invention relates to a method and an apparatus for winding a wire rod which is fed from a rolling mill along a predetermined path.

2. Related Art Statement

In the art of winding a wire rod which is run along a predetermined path from a rolling mill, a wire rod winder of a reel type, for example, is used. In the case where billets are efficiently rolled into wire rods at relatively short intervals, the successively produced wire rods are led to alternately or sequentially selected ones of plural stationary winders, along respective paths which lead to the stationary winders. More specifically, each of the wire rods from a rolling mill is first introduced into a branching or switching device which selects one of the plural wire paths that leads to the winder which is currently assigned to wind the wire rod. In this arrangement, the wire rod which is currently fed from the rolling mill is wound in the form of a coil by one of the plural winders, while the coil already wound by another winder is taken out so that this unloaded winder is able to wind a wire rod which will be fed thereto in the next winding cycle.

PROBLEMS SOLVED BY THE INVENTION

In the above-described arrangement for winding successively produced wire rods, however, plural wire paths should be provided between the branching device and the respective stationary wire winders. For example, when two wire winders are used, two wire paths must be formed so as to feed the wire rods from the branching device to each of the two winders. If it is furthermore desired to wind a wire rod in a desired one of opposite directions (either clockwise or counterclockwise) on each of the two winders, two wire paths must be provided for each of the two winders, one path for producing a clockwise coil, and the other path for producing a counterclockwise coil. Consequently, a total of four wire paths are required in order to enable each of the two wire winders to operate in either of the two winding directions.

In this connection, it is noted that each wire path extending from a branching device is formed in a line which is defined by cooling devices, pinch roll units, guide tubes, guide rolls, a support post, a wire inlet tube, and other members. Accordingly, the cost of the wire winding equipment and the required area of installation are increased as the number of wire paths is increased. In addition to the above inconveniences, the conventional arrangement suffers a problem that the wire rods are likely to be damaged due to frictional contact with the branching device while the direction of feed of the wire rod is changed at and by the branching device, whereby the quality of the produced coil is lowered.

SUMMARY OF THE INVENTION

It is therefore an object of the present invention to provide a method and an apparatus for winding a wire rod supplied from a rolling mill, which are capable of producing coils of wire with improved quality, at high efficiency, and with minimum cost.

According to the invention, there is provided a method of winding wire rods which are fed in succession from a rolling mill along at least one wire path, comprising the steps of: (1) providing a plurality of wire winders which are disposed, in a mutually spaced-apart relation, at one end of the wire path remote from the rolling mill; (2) positioning one of the wire winders at its winding position and winding the wire rod as a first coil by this one wire winder; (3) upon completion of winding of the wire rod as the first coil, positioning the above one wire winder to its non-winding position before the leading end of the next wire rod fed from the rolling mill reaches the above-identified one end of the wire path, and positioning another of the wire winders in its winding position; and (4) winding the next wire rod as a second coil by the above another wire winder, while concurrently taking out the first coil from the previously operated one wire winder.

According to another aspect of the invention, there is provided an apparatus for winding wire rods which are fed in succession from a rolling mill along at least one wire path, comprising: a carriage which is movable, at one end of the wire path remote from the rolling mill, in a direction perpendicular to the wire path; a plurality of wire winders for winding the wire rods, the wire winders being mounted on the carriage such that the wire winders are disposed in the direction of movement of the carriage; and drive means for moving the carriage to position selected one of the wire winders to its winding position.

In the method or apparatus of the present invention described above, the wire winders are selectively brought into their winding position. Consequently, the wire rods which are successively fed from the rolling mill at relatively short time intervals may be led to a selected one of the plural wire winders, without branching the wire path originating from the rolling mill into plural branch paths corresponding to the plural wire winders. In other words, the wire rods may be supplied to the appropriate wire winders along a single wire path. Thus, the instant winding method or apparatus makes it possible to achieve a considerable reduction in the number of components of the wire path arrangement such as a branching device, a cooling device, pinch rolls, guide tubes, guide rolls, posts, and wire inlet tubes, whereby the overall cost of the equipment and the installation space may be minimized. Moreover, the elimination of a branching device frees the wire rods from otherwise possible bending stresses and consequent frictional damages when the direction of feed of the wire rod is changed at the branching device.

According to an advantageous embodiment of the apparatus of the invention, the carriage may be a truck having wheels which roll on rails extending in the direction perpendicular to the wire path. In this case, the drive means for moving the truck may comprise a hydraulic cylinder.

According to another advantageous embodiment of the invention, each of the wire winders comprises a substantially cylindrical drum which is rotatable about its vertical axis and open at its upper end. The wire rod is introduced through the upper open end and wound in the cylindrical drum.

In accordance with a further advantageous embodiment, the wire rods are fed from the rolling mill along a single wire path to the carriage, and the plural wire winders consist of two wire winders which are spaced from each other in the direction perpendicular to the wire path.

BRIEF DESCRIPTION OF THE DRAWING

The foregoing and other objects, features and advantages of the present invention will be better understood from reading the following detailed description of a preferred embodiment of the invention, when considered in connection with the accompanying drawing, in which.

DETAILED DESCRIPTION OF THE PREFERRED EMBODIMENT

To further clarify the concept of the present invention, two preferred embodiments of the invention will be described by reference to the accompanying drawings.

Figure 1:
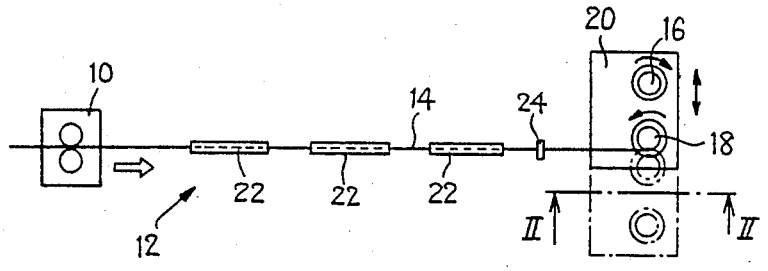
FIG. 1 is a schematic plan view of billet rolling and wire winding equipment which includes a first embodiment of a wire winding apparatus of the invention.

Referring first to FIG. 1, there is shown a general arrangement of billet rolling and wire winding equipment constructed according to a first embodiment the invention, which is suitable for practicing the method of the invention. The equipment comprises a finish rolling-mill stand 10 which is disposed as the last stage of a hot-rolling process. A wire rod 14 fed from the rolling-mill stand 10 is guided along a linear wire path 12 which leads to a carriage in the form of a truck 20. The truck 20 carries thereon two wire winders 16, 18 which are spaced from each other along a line perpendicular to the wire path 12. The truck 20 is movable in the direction in which the two wire winders 16, 18 are disposed, i.e., perpendicularly to the wire path 12. The wire path 12 is formed in a line which is defined by plural cooling devices 22 for cooling the wire rod 14, pinch rolls 24 for guiding the wire rod 14, and other members necessary to guide the wire rod 14 to the truck 20.

Figure 2:
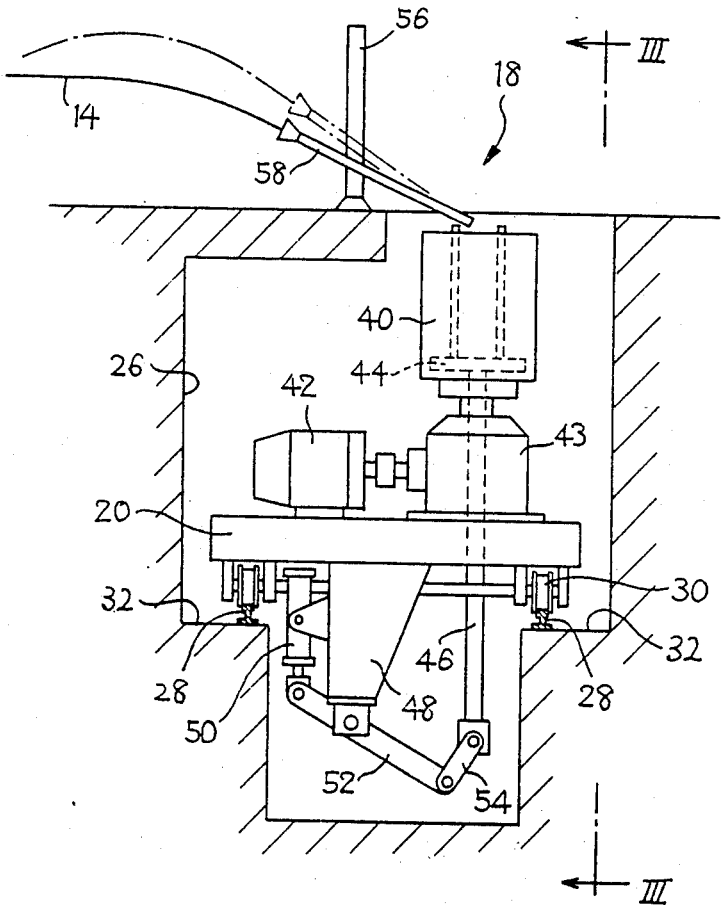
FIG. 2 is an elevational view of a wire winding apparatus taken along line II—II of FIG. 1.
Figure 3:
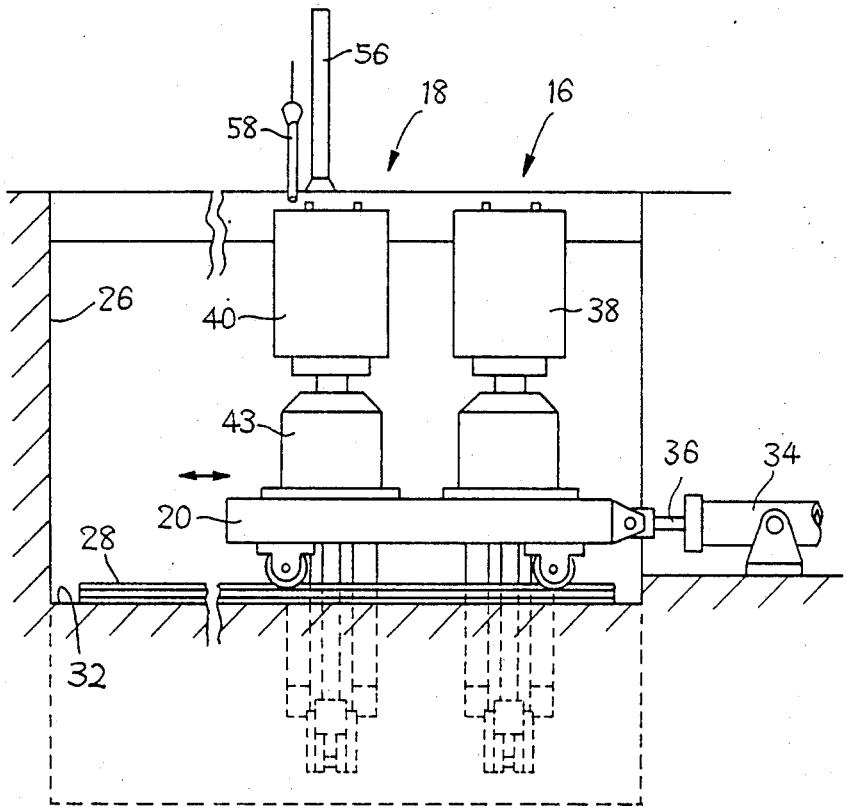
FIG. 3 is an elevational view of the wire winders taken along line III—III of FIG. 2.

As illustrated in detail in FIGS. 2 and 3, there is formed a pit 26 in the ground floor. On shouders 32 which partially define the pit 26, a pair of rails 28 are laid in parallel with each other, so that the rails 28 run perpendicularly to the wire path 12. The truck 20 is adapted to move with its wheels 30 rolling on the rails 28. More specifically stated, the truck 20 is connected at its one end to a piston rod 36 of a hydraulic cylinder 34 which is fixedly disposed in the pit 26, so as to serve as a major component of drive means for moving the truck 20. This drive means further includes limit switches (not shown) which are disposed at four positions along the rails 28, so that the piston rod 36 and consequently the truck 20 may be moved to a desired one of four positions correpsonding to the positions of the limit switches. The four positions of the truck 20 correspond to two winding positions of a first reel 38 (which will be described), and two winding positions of a second reel 40 (which will be described). One of the two winding positions for each reel 38, 40 is assigned for winding the wire rod 14 into a clockwise coil, and the other winding position is for winding the wire rod 14 into a counterclockwise coil. Thus, the truck 20 is positioned selectively at one of the four winding positions.

The wire winders 16, 18 mounted on the truck 20 are of the reel type, each including the previously indicated reel 38, 40 in the form of a cylindrical winding drum which is rotable about its axis. Since these two wire winders 16 and 18 are identical to each other in construction, the following description refers only to the wire winder 18.

The second reel 40 is rotated by a drive motor 42 via a reduction gear 43, and closed at its bottom end by a support disc 44 as indicated in FIG. 2, while the wire rod 14 is wound in the second reel 40. The support disc 44 is movable in the second reel 40 in the vertical direction, by an elevator rod 46 which is disposed co-axially with the second reel 40 and is movable up and down along the axis of rotation of the second reel 40. Described in greater detail, the elevator rod 46 (whose upper end is secured to the support disc 44) is operatively connected at its lower end to a hydraulic cylinder 50 through a lever 52 and a link 54. The hydraulic cylinder 50 is fixed to a bracket 48 which extends downwardly from the bottom of the truck 20. The lever 52 is pivotally supported on the bracket 48 and connected at its opposite ends to the cylinder 50 and the link 54, respectively. Linear movements of the piston of the hydraulic cylinder 50 will cause the lever 52 to pivot in opposite directions, thereby moving the elevator rod 46 up and down via the link 54. In this arrangement, the support disc 44 at the upper end of the elevator rod 46 is held at its lower position indicated in broken line in FIG. 2 while the wire rod 14 is being wound as a coil in the second reel 40, but, after the completion of the winding cycle, the support disc 44 on which the coil is wound is moved upward to its upper position upon activation of the hydraulic cylinder 50, so that the coil may be pushed out of the second reel 40.

Adjacent to the edge of the pit 26, a post 56 is erected for supporting in a known manner a wire inlet tube 58 which forms the terminal portion of the wire path 12. This wire inlet tube 58 (through which the wire rod 14 is passed) is oriented so that the wire rod 14 is lead into an upper part of the second reel 40 or the first reel (38). Depending upon the specific thickness (diameter or cross sectional area) of the wire rod 14, the vertical position and angle of inclination of the wire inlet tube 58 with respect to the post 56 are changed as illustrated in solid and broken lines in FIG. 2. Namely, the angle of the terminal portion of the wire path 12 is suitably adjusted to the thickness of the wire rod 14. Alternatively, it is possible to use a switching device to branch the terminal portion of the wire path 12.

The operation of the first embodiment will be described.

In the case where the wire rod 14 is wound as a counterclockwise coil by the wire winder 18, the truck 20 is moved to the position indicated in solid line in FIG. 1, i.e., to a winding position of FIG. 3, for positioning the second reel 40 so that the wire inlet tube 58 points into the upper open end portion of the second reel 40. More precisely, the truck 20 is positioned so that the left-hand side end (as viewed in FIG. 3) of the upper open end of the second reel 40 is aligned with the wire inlet tube 58, as shown in FIG. 3. In this position, the second reel 40 is rotated at a peripheral speed substantially equal to the feed speed of the wire rod 14 as it is fed from the finish rolling-mill stand 10 which produces the wire rod 14 by rolling a billet. With the wire rod 14 fed into the rotating second reel 40, the wire rod 14 is wound as a counterclockwise coil in the second reel 40. While the winding operation is being performed on the second reel 40, the coil already wound in the first reel 38 is removed from the first reel 38.

Upon completion of the winding cycle in the second reel 40, the truck 20 is moved by the hydraulic cylinder 34 to another winding position, indicated in broken line in FIG. 1, at which the wire inlet tube 58 is brought into aligment with the upper open end of the first reel 38, before the leading end of the next wire rod 14 reaches the first reel 38. Thus, the truck 20 is positioned so that the winders 16 and 18 are located at their winding and non-winding positions.

Subsequently, the new wire rod 14 is wound in the first reel 38 as a clockwise coil. In the meantime, the support disc 44 in the second reel 40 is raised to take out the counterclockwise coil which has been produced in the second reel 40.

Figure 5:
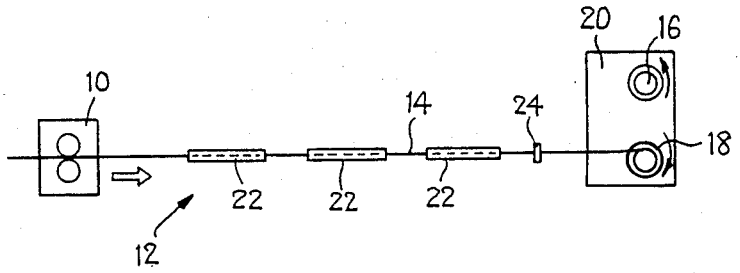
FIG. 5 is a schematic plan view of billet rolling and wire winding equipment which includes a second embodiment of a wire winding apparatus of the invention.

With the above winding cycle repeated, the wire rods 14, which are successively fed along the single wire path 12 from the finish rolling-mill stand 10 at relatively short time intervals, may be wound alternately in one of the two reels 40, 38, with minimum non-productive time--i.e., with high winding efficiency. When it is desired to wind the wire rods 14 in the counterclockwise direction in the first reel 38, or in the clockwise direction in the second reel 40, this winding operation in the reverse direction may be readily accomplished by moving the truck 20 to change the winding position, so that the wire inlet tube 58 is aligned respectively with the left-hand side edge and the right-hand side edge (in FIG. 3) of the first reel 38 and the second reel 40 in the same way as previously indicated. This second embodiment of the invention is illustrated in FIG. 5. In this instance, the direction of rotation of the reels 38, 40 should be reversed. Since the reels 38, 40 on the truck 20 are movable, there is no need to branch the single wire path 12 for feeding the wire rod 14 to different positions for clockwise and counterclockwise winding operations for each reel.

As described hitherto, the instant winding system or apparatus and method are adapted to efficiently handle wire rods 14 which are fed in succession from the finish rolling-mill stand 10 at comparatively short intervals, and along the single wire path 12. In other words, the successively fed wire rods 14 are wound alternately in one of the two reels 38, 40 while the reels 38, 40 are held at the appropriate winding positions. Hence, the instant apparatus and method make it possible to considerably simplify the wire path, that is, contribute to reduction in the number of components constituting the wire path 12, such as a branching device, cooling devices, pinch rolls, guide tubes, guide rolls, support post, and wire inlet tubes. Consequently, the cost of the wire winding equipment as a whole, and the installation area required, are reduced to an appreciable extent. Further, since the instant apparatus does not require a branching device for feeding the wire rod along one of plural wire paths as used in the conventional system, the wire rod 14 is not marred or otherwise damaged due to a bending force applied during a pass through the branching device. Thus, the conventionally encountered deterioration of quality of the produced coils is eliminated, or at least minimized.

Figure 4:
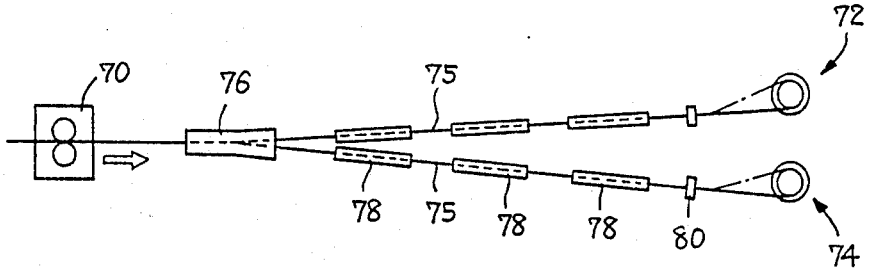
FIG. 4 PRIOR ART
FIG. 4 is a schematic plan view corresponding to FIG. 1, showing a known arrangement of billet rolling and wire winding equipment.

For comparison, an example of a conventional system is shown in FIG. 4, wherein a single wire path originating from a finish rolling-mill stand 70 is branched by a branching device 76 into two wire paths which lead to two stationary wire winders 72 and 74 provided for the single finish rolling-mill stand 70. In the case where the wire rods 75 are wound selectively in the clockwise or counterclockwise direction in each of the two winders 72, 74, each of the branch wire paths should be further branched into two branch paths for the clockwise and counterclockwise coils. This will increase the number of wire paths, and the total length of the wire paths, thereby requiring a larger number of components such as cooling devices 78 and pinch rolls 80 for the entire equipment. Accordingly, the conventional system suffers relatively high equipment cost and large space requirement for installation. Furthermore, the produced coils are degraded in quality due to damages of the wire rods 75 which are subjected to a bending force while they are passed through one or more branching devices.

While the present invention has been described in its preferred form, it is to be understood that the invention is not confined to the precise disclosure contained herein, but may be otherwise embodied, with various changes, modifications and improvements.

For example, the truck 20 which carries the wire winders 16, 18 and is movable with its wheels 30 rolling on the rails 28 by the hydraulic cylinder 34, may be moved by an electric motor. Further, the truck 20 may be replaced by a carriage or other forms of movable means, which is movable by means of a slide slidable on a suitable bearing surfaces, or by means of a suitable link mechanism. Further, the carriage may be replaced by a rotary turning table which is rotatable about the vertical axis.

While the truck 20 carries the two winders in the illustrated embodiment, three or more winders may be mounted on the truck or similar movable means indicated above.

The reels 38, 40 used in the illustrated embodiment are provided in the form of cylindrical drums with a support disc. However, it is possible that the reels be formed by a plurality of pins which are secured to a suitable base and which are disposed in mutually spaced-apart relation along a profile of a coil to be produced.

It will be obvious to those skilled in the art that other changes and modifications may be made, in view of the foregoing teaching, without departing from the scope of the invention defined in the appended claims.

What is claimed is:

1. A method of winding wire rods into coils, said method comprising the steps of:

(a) feeding a plurality of wire rods in succession from a rolling mill along a single linear wire path;

(b) providing a first wire winder and a second wire winder in mutually spaced apart relation and mounted on a carriage which is movable to and fro on a linear carriage path that intersects and is perpendicular to said single linear wire path, said first and second wire winders each being rotatable about a vertical axis, said first wire winder having a first side that faces said second wire winder and a second side that is remote from said second wire winder and said second wire winder having a first side that faces said first wire winder and a second side that is remote from said first wire winder;

(c) positioning said carriage so that the first side of said first wire winder is in alignment with said single wire path; then (d) rotating said first wire winder in a first angular direction so as to wind a first wire rod into a first coil; then (e) positioning said carriage so that the first side of said second wire winder is in alignment with said single wire path; and then (f) rotating said second wire winder in a second angular direction, opposite from said first angular direction, so as to wind a second wire rod into a second coil.

2. A method of winding wire rods into coils as recited in claim 1 and further comprising the steps of:

(a) after step (f) in claim 1, positioning said carriage so that the first side of said first wire winder is in alignment with said single wire path; then (b) rotating said first wire winder in said first angular direction so as to wind a third wire rod into a third coil; and then (c) continuing alternate use of said first and second wire winders, always aligning the first side of each wire winder with said single wire path before rotating each wire winder.

3. Apparatus for winding wire rods into coils, said apparatus comprising:

(a) first means for feeding a plurality of wire rods in succession from a rolling mill along a single linear wire path;

(b) a carriage movable to and fro on a linear carriage path that intersects and is perpendicular to said single wire path;

(c) a first wire winder and a second wire winder mounted on said carriage in mutually spaced apart relation on a line perpendicular to said single wire path, said first and second wire winders each being rotatable about a vertical axis, said first wire winder having a first side that faces said second wire winder and a second side that is remote from said second wire winder and said second wire winder having a first side that faces said first wire winder and a second side that is remote from said first wire winder;

(d) second means for moving said carriage linearly back and forth between a first position in which the first side of said first wire winder is in alignment with said single wire path and a second position in which the first side of said second wire winder is in alignment with said single wire path;

(e) third means for rotating said first wire winder in a first angular direction so as to wind a first wire rod into a first coil; and (f) fourth means for rotating said second wire winder in a second angular direction, opposite from said first angular direction, so as to wind a second wire rod into a second coil.

* * * * *